US008739588B2

(12) United States Patent
Burmesch et al.

(10) Patent No.: US 8,739,588 B2
(45) Date of Patent: Jun. 3, 2014

(54) ANTI-TAMPERING ARRANGEMENTS FOR PIN TUMBLER CYLINDER LOCKS

(75) Inventors: Gary Burmesch, Port Washington, WI (US); Jesse Marcelle, Muskego, WI (US); Glenn Meekma, Menomonee Falls, WI (US)

(73) Assignee: Master Lock Company LLC, Oak Creek, WI (US)

( * ) Notice: Subject to any disclaimer, the term of this patent is extended or adjusted under 35 U.S.C. 154(b) by 46 days.

(21) Appl. No.: 13/431,244

(22) Filed: Mar. 27, 2012

(65) Prior Publication Data

US 2012/0180537 A1 Jul. 19, 2012

Related U.S. Application Data

(63) Continuation of application No. 12/018,528, filed on Jan. 23, 2008, now Pat. No. 8,166,783.

(60) Provisional application No. 60/903,112, filed on Feb. 23, 2007, provisional application No. 60/921,765, filed on Apr. 4, 2007, provisional application No. 60/916,629, filed on May 8, 2007, provisional application No. 60/941,134, filed on May 31, 2007, provisional application No. 60/951,789, filed on Jul. 25, 2007.

(51) Int. Cl.
*E05B 27/00* (2006.01)

(52) U.S. Cl.
USPC ..... 70/493; 70/378; 70/392; 70/419; 70/416

(58) Field of Classification Search
USPC ..... 70/358, 367, 371–373, 378, 409, 70/416–419, 392, 493
See application file for complete search history.

(56) References Cited

U.S. PATENT DOCUMENTS

| | | | |
|---|---|---|---|
| 1,047,483 | A | 12/1912 | Augenbraun |
| 1,172,203 | A | 2/1916 | Fuller |
| 2,022,070 | A | 11/1935 | Williams et al. |

(Continued)

FOREIGN PATENT DOCUMENTS

| | | | |
|---|---|---|---|
| DE | 103 33 211 | A1 | 3/2005 |
| EP | 02384443 | B1 | 10/1990 |

OTHER PUBLICATIONS

Tommy Tyler, The History and Science of Lock Pick Guns, Mar. 15, 2005, 12 pages.

(Continued)

*Primary Examiner* — Suzanne Barrett
(74) *Attorney, Agent, or Firm* — Calfee, Halter & Griswold LLP

(57) ABSTRACT

A pin tumbler cylinder lock includes a shell, a plug, and at least first and second tumbler pins and first and second driver pins. At least the first driver pin extends into a corresponding plug channel when the plug is in a locked condition, such that rotation of the plug with respect to the shell is blocked. The lock is configured such that at least the first driver pin is separated from the first tumbler pin by a gap when the plug is in the locked condition. When the first and second tumbler pins are raised without the proper key and the gap between the first tumbler pin and the first driver pin is eliminated, the second tumbler pin extends across the shear line and into the corresponding shell channel.

9 Claims, 7 Drawing Sheets

(56) References Cited

U.S. PATENT DOCUMENTS

| | | | | |
|---|---|---|---|---|
| 2,059,129 | A * | 10/1936 | Maxwell et al. | 70/493 |
| 2,111,515 | A | 3/1937 | Rauh | |
| 2,158,501 | A | 8/1938 | Gutman | |
| 2,149,733 | A * | 3/1939 | Hagendorn et al. | 70/493 |
| 2,194,959 | A | 3/1940 | Voight | |
| 2,370,800 | A | 3/1945 | Kind et al. | |
| 3,111,834 | A | 11/1963 | Felson | |
| 3,393,541 | A | 7/1968 | Wake | |
| 3,408,837 | A | 11/1968 | Felson | |
| 3,416,336 | A | 12/1968 | Felson | |
| 3,512,382 | A | 5/1970 | Check et al. | |
| 3,518,855 | A | 7/1970 | Wake | |
| 3,566,637 | A | 3/1971 | Hallmann | |
| 3,584,484 | A | 6/1971 | Hallmann et al. | |
| 3,599,456 | A | 8/1971 | Bessim | |
| 3,654,782 | A | 4/1972 | Heimann | |
| 3,656,328 | A | 4/1972 | Hughes | |
| 3,660,999 | A | 5/1972 | Janzen | |
| 3,665,740 | A | 5/1972 | Taniyama | |
| 3,869,889 | A | 3/1975 | Prahl | |
| 3,935,720 | A | 2/1976 | Boving | |
| 3,952,345 | A | 4/1976 | Spitz | |
| 4,026,134 | A | 5/1977 | Woolfson | |
| 4,094,175 | A | 6/1978 | Pechner | |
| 4,098,103 | A | 7/1978 | Paskevicius | |
| 4,103,526 | A | 8/1978 | Surko, Jr. | |
| 4,142,389 | A | 3/1979 | Bahry et al. | |
| 4,227,387 | A | 10/1980 | Steinbach | |
| 4,333,327 | A | 6/1982 | Wake | |
| 4,341,102 | A | 7/1982 | Ku et al. | |
| 4,380,162 | A | 4/1983 | Woolfson | |
| 4,403,486 | A | 9/1983 | Miyake | |
| 4,756,177 | A | 7/1988 | Widen | |
| 4,856,309 | A | 8/1989 | Eizen | |
| 4,905,489 | A | 3/1990 | Keller | |
| 4,932,229 | A | 6/1990 | Genakis | |
| 4,998,426 | A | 3/1991 | Genakis | |
| 5,016,455 | A | 5/1991 | Hennessy | |
| 5,074,136 | A | 12/1991 | Kim et al. | |
| 5,123,268 | A | 6/1992 | Eizen | |
| 5,222,383 | A | 6/1993 | Fann et al. | |
| 5,894,750 | A | 4/1999 | Liaw | |
| 5,966,971 | A | 10/1999 | Keller | |
| 6,041,628 | A | 3/2000 | Lin | |
| 6,367,297 | B1 | 4/2002 | Mottura | |
| 6,675,617 | B2 | 1/2004 | Stemmerik | |
| 6,705,139 | B2 | 3/2004 | Tsai | |
| 7,086,259 | B2 | 8/2006 | Almoznino | |
| 7,100,409 | B2 | 9/2006 | Chang | |
| 7,181,941 | B2 | 2/2007 | Eden, Jr. | |
| 7,272,965 | B2 | 9/2007 | Dolev | |
| 7,392,676 | B2 | 7/2008 | Eden, Jr. | |
| 7,707,864 | B1 | 5/2010 | Melendez et al. | |
| 8,166,783 | B2 | 5/2012 | Burmesch et al. | |
| 2003/0037579 | A1 | 2/2003 | Wu | |
| 2005/0022568 | A1 | 2/2005 | Dolev | |
| 2006/0048554 | A1 | 3/2006 | Keller | |
| 2006/0059965 | A1 | 3/2006 | Benstead | |
| 2007/0157688 | A1 | 7/2007 | Weber et al. | |
| 2008/0105017 | A1 | 5/2008 | Owens | |
| 2008/0127694 | A1 | 6/2008 | Wong et al. | |
| 2008/0202180 | A1 | 8/2008 | Eller et al. | |
| 2008/0271507 | A1 | 11/2008 | Hocut | |
| 2008/0302150 | A1 | 12/2008 | Wu et al. | |
| 2008/0314104 | A1 | 12/2008 | Hsieh | |
| 2008/0314105 | A1 | 12/2008 | Lawson et al. | |
| 2009/0056396 | A1 | 3/2009 | Liu | |
| 2009/0107195 | A1 | 4/2009 | Gallian | |
| 2009/0173121 | A1 | 7/2009 | Cheng et al. | |
| 2009/0205385 | A1 | 8/2009 | Cozzolino | |

OTHER PUBLICATIONS

International Search and Written Opinion from International Application No. PCT/US2008/051786, mailed Jul. 18, 2008.
Notice of Allowance from. U.S. Appl. No. 12/108,528, mailed Mar. 21, 2012.
Notice of Panel Decision from Pre-Appeal Brief from U.S. Appl. No. 12/108,523, mailed Mar. 16, 2012.
Reasons for Requesting Pre-Appeal Brief Review from U.S. Appl. No. 12/108,523, dated Mar. 2, 2012.
Advisory Action Before the Filing of an Appeal Brief from U.S. Appl. No. 12/108,523, dated Feb. 8, 2012.
Amendment and Response to Final Office Action dated Dec. 8, 2011 from U.S. Appl. No. 12/108,523, dated Feb. 1, 2012.
Office Action dated Dec. 8, 2011 from U.S. Appl. No. 12/108,523, dated Dec. 20, 2011.
Response to Office Action dated Jun. 9, 2011 from U.S. Appl. No. 12/108,523, dated Sep. 20, 2011.
Office Action from U.S. Appl. No. 12/108,523, dated Jun. 9, 2011.
Interview Summary from U.S. Appl. No. 12/108,523, dated Mar. 22, 2011.
Response to Office Action dated Dec. 23, 2010 from U.S. Appl. No. 12/108,523, dated Mar. 22, 2011.
Office Action from U.S. Appl. No. 12/108,523, Dec. 23, 2010.
Response to Office Action dated Aug. 20, 2010 from U.S. Appl. No. 12/108,523, dated Oct. 11, 2010.
Office Action from U.S. Appl. No. 12/108,523,n dated Aug. 20, 2010.
Search Report from European Patent Application No. 08151650.2 dated May 10, 2013.

* cited by examiner

ANTI-TAMPERING ARRANGEMENTS FOR PIN TUMBLER CYLINDER LOCKS

CROSS REFERENCE TO RELATED APPLICATIONS

This application is a continuation of U.S. patent application Ser. No 12/018,528, filed Jan. 23, 2008, the entire disclosure of which is hereby incorporated by reference, which claims the benefit of the following U.S. Provisional Patent Applications, the entire disclosures of which are hereby incorporated by reference, to the extent that they are not conflicting with the present application: App. Ser. No. 60/903,112, entitled "Anti-Tampering Arrangements for Pin Tumbler Cylinder Locks" and filed Feb. 23, 2007; App. Ser. No. 60/1921,765, entitled "Anti-Tampering Arrangements for Pin Tumbler Cylinder Locks" and filed Apr. 4, 2007; App. Ser. No. 60/916,629, entitled "Anti-Tampering Arrangements for Pin Tumbler Cylinder Locks" and filed May 8, 2007; App. Ser. No. 60/1941,134, entitled "Anti-Tampering Arrangements for Pin Tumbler Cylinder Locks" and filed May 31, 2007; and App. Ser. No. 60/951,789, entitled "Anti-Tampering Arrangements for Pin Tumbler Cylinder Locks" and filed Jul. 25, 2007.

FIELD

The present invention relates to pin tumbler cylinder locks and to anti-tampering arrangements for pin tumbler cylinder locks.

BACKGROUND

The pin tumbler cylinder lock has been used since the mid-19th century to restrict unauthorized access to an item, an enclosure, or a location, for example, as a door lock. A conventional pin tumbler cylinder lock 10, as shown in FIG. 1A, includes a cylinder plug 20 rotatable in a cylinder housing or shell 30. The plug 20 and shell 30 each include a series of channels 25, 35, with the plug channels 25 intersecting a keyway 27 in the plug 20. When the lock 10 is in a locked condition, pin sets including outer driver pins 39 and inner tumbler pins 29 extend radially through the aligned plug and shell channels 25, 35, with springs 38 disposed in the shell channels 35 to bias the driver pins 39 partially (and typically at varying distances for each pin) into the cylinder channels 25 to prevent rotation of the plug 20 with respect to the shell 30. When an authorized key is inserted into the keyway of the lock (not shown), notches on the key engage the tumbler pins 29 and slide the tumbler pins 29 and driver pins 39 against the springs 38, such that each tumbler pin 29 is substantially disposed in the corresponding plug channel 25, and each driver pin 39 is substantially disposed in the corresponding shell channel 35, clearing a shear line between the plug 20 and the shell 30. When this shear line is clear, the driver pins 35 and tumbler pins 25 are each in a position of non-interference with respect to the intersections of the plug and shell channels 25, 35, and the cylinder plug 20 is permitted to rotate within the shell 30 and unlock an associated locking member, such as a dead bolt (not shown).

The conventional pin tumbler cylinder lock may be susceptible to unauthorized opening. As one example, lock picking involves the use of thin picks inserted in the keyway to manipulate the driver and tumbler pins to position the pins for rotation of the plug. As another example, as illustrated in FIGS. 1A and 1B, a technique referred to as "bumping" involves the insertion of an impact transmitting device, such as, for example, a "bump" key K into the keyway 27 of a pin tumbler cylinder lock 10 such that bitted portions B on the key K align with each of the channels 25. By bumping or rapping the inserted bump key K, the impact forces of the bitted portions striking the tumbler pins 29, as shown by arrows in FIG. 1B, is translated to the driver pins 39, causing the driver pins 39 to momentarily separate from the tumbler pins 29 along the intersections of the plug and shell channels 25, 35, and move fully within the shell channels 35, thereby allowing rotation of the bump key K and plug 20 as the bump key K is rapped. This separation of the driver pin 39 from the tumbler pin 29 may occur upon impact of the tumbler pin with the driver pin (a "pool ball" type effect), or after bumping, where the tumbler pin begins to drop back into the plug channel 25 before the driver pin 39 begins to drop. As known in the art, other impact transmitting devices, such as, for example, a vibratory pick gun or blowgun, operate under the same principle, by impacting the tumbler pins 29, which in turn impact and move the corresponding driver pins 39.

SUMMARY

The present application contemplates various inventive features for a pin tumbler cylinder lock that, alone or in combination, may impede unauthorized access to a locked structure by bumping the lock. According to an inventive aspect of the present application, a pin tumbler cylinder lock may be adapted such that at least one driver pin and/or tumbler pin in the lock remains extended across a shear line between a plug and a shell of the lock during a bumping operation, such that rotation of the plug with respect to shell is blocked. In one embodiment, the lock may be configured such that the portion of the impact of a bump key (or other such tool) during a bumping operation that is translated into movement of the corresponding driver pins is reduced, thereby impeding movement of the driver pins out of the corresponding plug channels to maintain blocked rotation of the plug with respect to the shell.

Accordingly, in one embodiment of the present application, a pin tumbler cylinder lock includes a shell, a plug, and at least first and second tumbler pins and first and second driver pins. At least the first driver pin extends into a corresponding plug channel when the plug is in a locked condition, such that rotation of the plug with respect to the shell is blocked. The lock is configured such that at least the first driver pin is separated from the first tumbler pin by a gap when the plug is in the locked condition. the first and second tumbler pins are raised without the proper key and the gap between the first tumbler pin and the first driver pin is eliminated, the second tumbler pin extends across the shear line and into the corresponding shell channel.

BRIEF DESCRIPTION OF THE DRAWINGS

Features and advantages of the invention will become apparent from the following detailed description made with reference to the accompanying drawings, wherein.

DETAILED DESCRIPTION

This Detailed Description of the Invention merely describes embodiments of the invention and is not intended to limit the scope of the invention in any way, Indeed, the invention as described in the claims is broader than and unlimited by the preferred embodiments, and the terms used in the claims have their full ordinary meaning.

The present application contemplates a pin tumbler cylinder lock arrangement configured to inhibit or deter unauthorized operation of a lock by bumping, for example, with a bump key or pick gun. According to an inventive aspect of the present application, a pin tumbler cylinder lock arrangement may be configured such that a gap is provided between at least one of the tumbler pins and the corresponding driver pin when the lock is in a locked or pre-bump condition. As a result, when the tumbler pin is bumped, a significant amount of the kinetic energy produced is used first to cause the tumbler pin to travel across the gap and move into contact with the corresponding driver pin before any energy is applied to move the driver pin. Further, the resultant force of impact on the driver pin is supplied only by the relatively low mass tumbler pin, instead of by the key and tumbler pin together or in contact with each other. As a result, the bumped tumbler pin is unable to bump the driver pin out of the plug channel. At the time when the tumbler pin and driver pin are in contact, the driver pin continues to span the shear line between the plug and the shell.

Many different configurations may be used to provide a gap between a tumbler pin and a corresponding driver pin in a pin tumbler cylinder lock arrangement. In one embodiment, an outer surface of the driver pin and/or an inner surface of the plug and or shell channels may be shaped or sized to limit the portion of the driver pin that may be received in the plug channel, resulting in a gap between the driver pin and the tumbler pin. In an exemplary embodiment, the pin and channel arrangement is configured such that the driver pin extends approximately 0.025 to 0.040 inches (0.64-1.02 mm) into the plug channel from the shear line between the plug and the shell. It should be apparent to one of ordinary skill in the art that other dimensions may be used in the practice of this invention. FIGS. 2A-E schematically illustrate exemplary pin and channel configurations for providing a gap between the driver pin and the tumbler pin when the pin tumbler cylinder lock is in a locked condition.

Figure 1A:
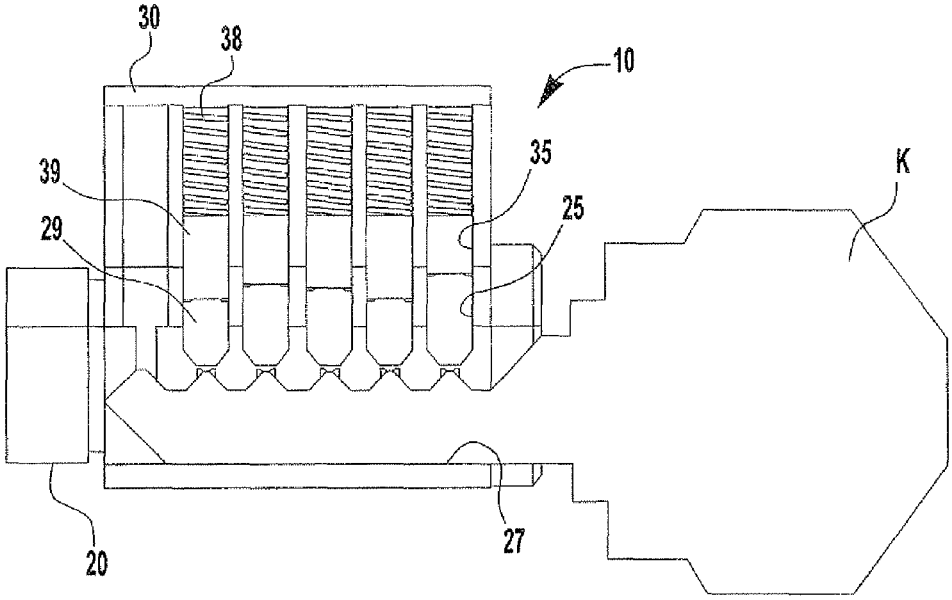
FIG. 1A illustrates a schematic cross sectional view of a pin tumbler cylinder lock.
Figure 1B:
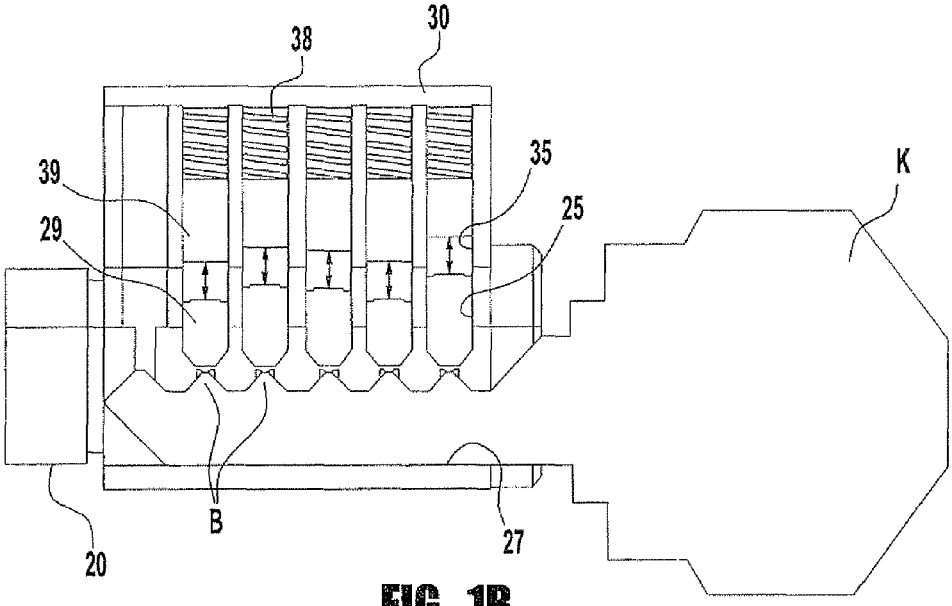
FIG. 1B illustrates a schematic cross sectional view of the lock of FIG. 1A, shown being manipulated by a bump key.
Figure 2A:
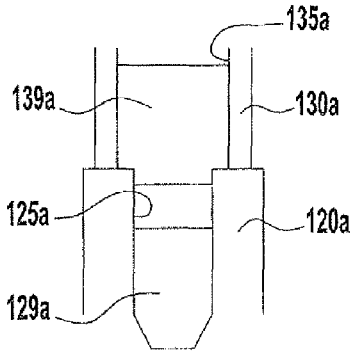
FIGS. 2A-2E illustrate schematic views of pin and channel configurations for a pin tumbler cylinder lock.
Figure 2B:
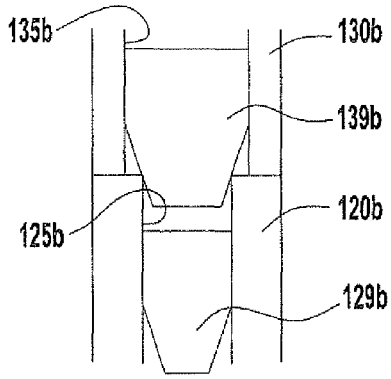

In some embodiments, as shown, for example, in FIGS. 2A and 2B, a gap may be provided by a configuration having a smaller diameter plug channel (relative to the corresponding shell channel) and a contoured driver pin. In the exemplary embodiment of FIG. 2A, a driver pin 139*a* includes a narrower stepped end portion receivable in the smaller plug channel 125*a*, and a wider main portion retained in the larger shell channel 135*a*. Interference between the plug 120*a* and the main portion of the driver pin 139*a* provides a gap between the driver pin 139*a* and the tumbler pin 129*a*. In the exemplary embodiment of FIG. 2B, a driver pin 139*b* includes a tapered portion which may, but need not, be at the end of the driver pin 139*b*, such that an end portion of the driver pin 139*b* is receivable in the smaller plug channel 125*b*. Interference between the wider portion of the driver pin 139*b* and the plug 120*b* provides a gap between the driver pin 139*b* and the tumbler pin 129*b*.

Figure 2C:
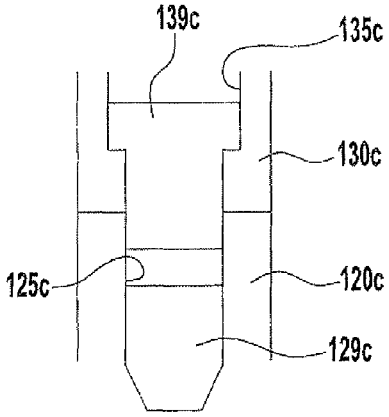

In other embodiments, as shown, for example, in FIG. 2C, a gap may be provided by a configuration having a contoured driver pin and a complementary shaped shell channel. In the exemplary embodiment of FIG. 2C, a driver pin 139*c* includes a narrower stepped end portion extendable into the plug channel 125*c*. A shoulder of the exemplary stepped driver pin 139*c* abuts a corresponding shoulder in the shell channel 135*c* to prevent further movement of the driver pin 139*c* into the plug channel 125*c* and to provide a gap between the driver pin 139*c* and the tumbler pin 129*c*. Other corresponding driver pin and shell channel surface features may be used, such as, for example, complementary tapered surfaces (not shown).

Figure 2D:
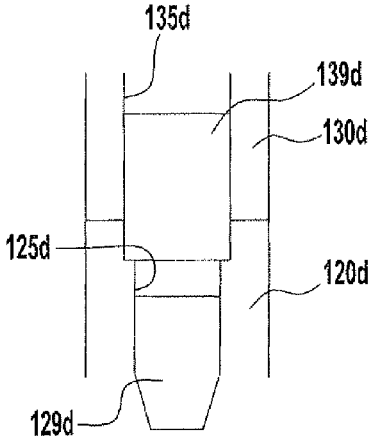
Figure 2E:
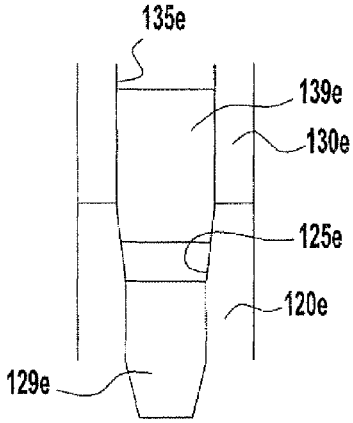

In still other embodiments, as shown in FIGS. 2D and 2E, a gap may be provided by a contoured plug channel. In the exemplary embodiment of FIG. 2D, a plug channel 125*d* includes a stepped end portion sized to receive the end of cylindrical driver pin 139*d*. The driver pin abuts a shoulder in the stepped plug channel 125*d* to prevent further movement of the driver pin 139*d* into the plug channel 125*d* and to provide a gap between the driver pin 139*d* and the tumbler pin 129*d*. The driver pin 139*d* includes a narrower stepped end portion receivable in the smaller plug channel 125*d*, and a wider main portion retained in the larger shell channel 135*d*. In the exemplary embodiment of FIG. 2E, a plug channel 125*e* includes a tapered portion sized to allow a portion of a cylindrical driver pin 139*e* to extend into the plug channel 125*e*, while preventing further movement of the driver pin 139*e* into the plug channel to provide a gap between the driver pin 139*e* and the tumbler pin 129*e*.

Figure 3A:
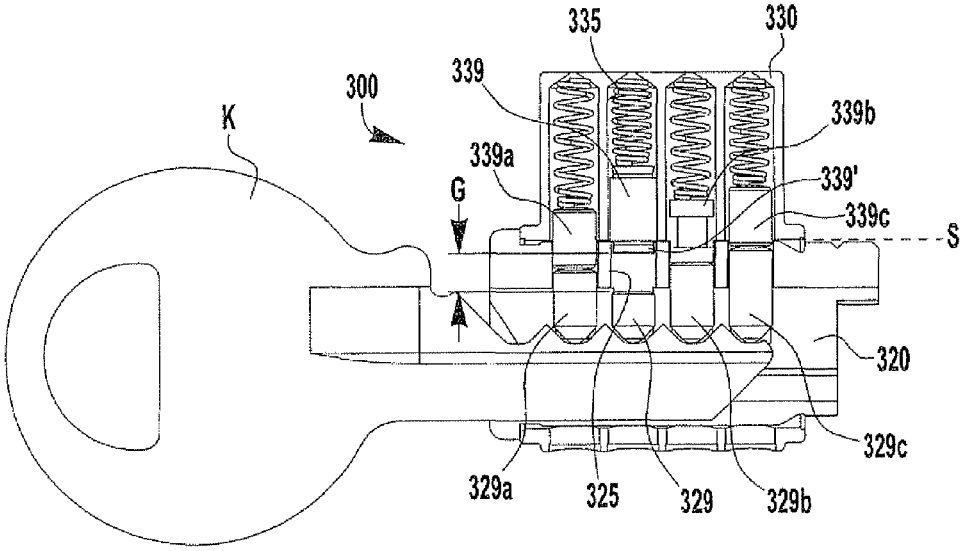
FIG. 3A illustrates a schematic cross sectional view of a pin tumbler cylinder lock having a pin with reverse tapered ends, with a bump key inserted in a pre-bump position.
Figure 3B:
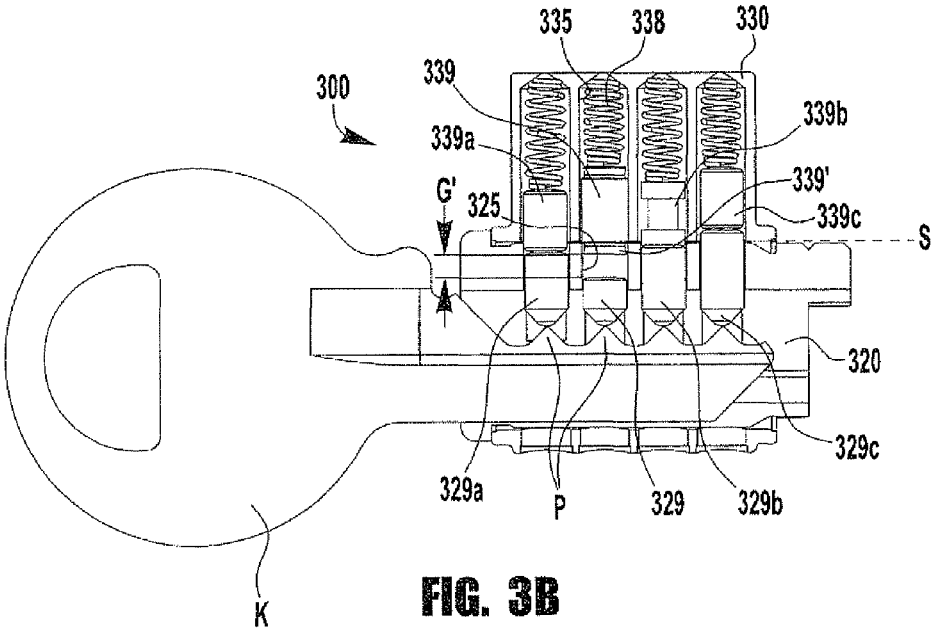
FIG. 3B illustrates a schematic cross sectional view of the lock of FIG. 3A, with a bump key inserted in a bump position.
Figure 3C:
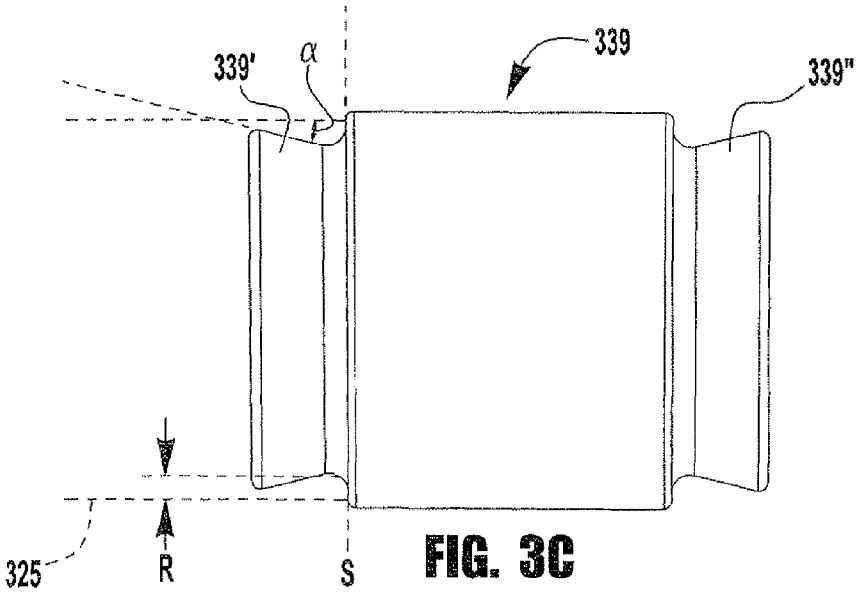
FIGS. 3C-3E illustrate side, end, and perspective views of a driver pin with reverse tapered ends.
Figure 3D:
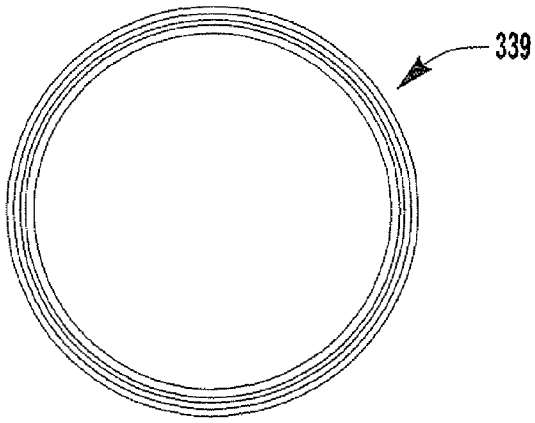
Figure 3E:
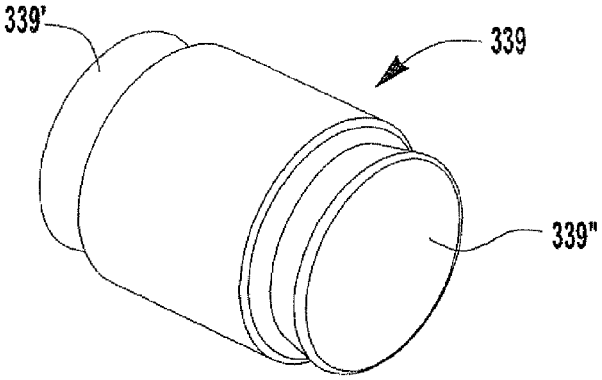

FIGS. 3A and 3B illustrate an exemplary pin tumbler cylinder lock 300 in which a smaller diameter plug channel 325 (relative to the corresponding shell channel 335) and a contoured driver pin 339 are configured to form a gap G between the driver pin 339 and a corresponding tumbler pin. In the illustrated embodiment, the driver pin 339 (shown more clearly in FIGS. 3C-3E) includes a narrower stepped end portion 339' receivable in the smaller plug channel 325, and a wider main body portion retained in the larger shell channel 335. While any suitable dimensions or configurations may be utilized, in one example, a pin tumbler cylinder lock may have a shell channel diameter of approximately 0.104 in. (2.64 mm) and a plug channel diameter of approximately 0.098 in. (2.49 mm), and a corresponding gap enabling driver pin 339 may have a main portion outer diameter of approximately 0.101 in. (2.57 mm) and a stepped portion outer diameter of 0.096 in. (2.44 mm). In such an exemplary arrangement, the stepped end portion 339' of the driver pin 339 is receivable in the plug channel 325, while the main portion of the driver pin 339 remains blocked by a ledge between the plug channel 325 and the shell channel 335 created by the difference in channel diameters. The exemplary stepped end portion 339' may, for example, be machined to exacting tolerances (e.g., +/−0.002 in. or 0.051 mm) to maintain a sufficient step between the main portion and the end or stepped portion.

Interference between the plug 320 and the main portion of the exemplary driver pin 339 provides a gap G between the driver pin and the tumbler pin 329 (as shown in FIG. 3A). When an inserted key K is bumped or rapped in an effort to bump the driver pin 339 completely out of the plug channel 325 and away from the tumbler pin 329 (see FIG. 3B), the tumbler pin 329 separates from the key K before impacting the driver pin 339. The relatively low mass of the tumbler pin 329 (compared to the key K and tumbler pin in contact with each other and impacting the driver pin together) and the loss of kinetic energy used to move the tumbler pin 329 into contact with the driver pin 339 result in a reduced impact force on the driver pin 339, thereby inhibiting movement of the driver pin 339 out of the plug channel 325. While not shown in FIGS. 3A and 3B, the other driver pins 339*a,* 339*b,* 339*c* and tumbler pins 329*a,* 329*b,* 329*c* in one or more of the remaining sets of channels 325, 335 may, but need not, be similarly configured to provide for gaps in the locked condition, by using, for example, similar tapered or stepped driver pins and reduced diameter plug channels.

While many different sized gaps between a tumbler pin and a driver pin may be utilized to inhibit bumping of the driver pin 339 by the tumbler pin 329 into the shell channel 335, in one embodiment, the gap may be dimensioned such that when a peak portion P of a conventional bump key K is aligned with the tumbler pin, a gap G' remains between the tumbler pin 329 and driver pin 339 (as shown in FIG. 3B), such that the tumbler pin 329, when bumped, must separate from the bump key K before the tumbler pin 329 impacts the driver pin 339, thereby reducing the force of impact with the driver pin 339. In one such embodiment, by pairing a gap enabling driver pin 339 with a "short" tumbler pin 329 (e.g., a code 0, 1, or 2 tumbler pin, in a lock having cut depths ranging from "0" to "7"), a gap may be maintained when the tumbler pin 329 is aligned with the peak P of a conventional bump key K. For example (and without limit to other possible combinations or configurations), alignment of a peak P of a code 7 bump key K (roots of bitted portion cut to a code 7 depth) with a code 0 tumbler pin 329, an exemplary gap enabling driver pin 339 may be configured to produce a gap of approximately 0.083 in. (2.11 mm) between the tumbler pin 329 and the driver pin 339. With a code 1 tumbler pin (in the same exemplary embodiment), a gap of approximately 0.052 in. (1.32 mm) would result, and with a code 2 tumbler pin, a gap of approximately 0.021 in. (0.53 mm) would remain.

Figure 4A:
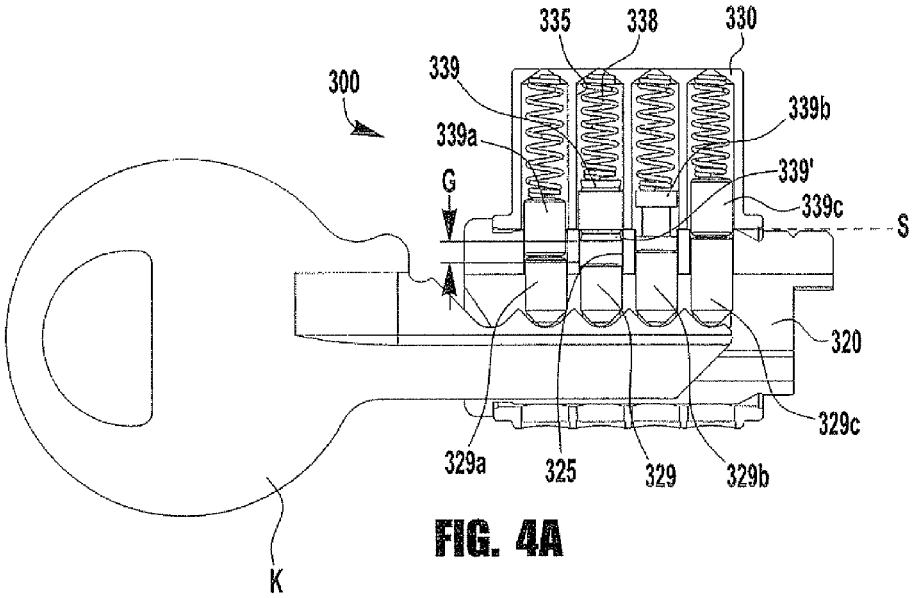
FIG. 4A illustrates a schematic cross sectional view of another pin tumbler cylinder lock having another alternative combination of tumbler pins, with a bump key inserted in a pre-bump position.
Figure 4B:
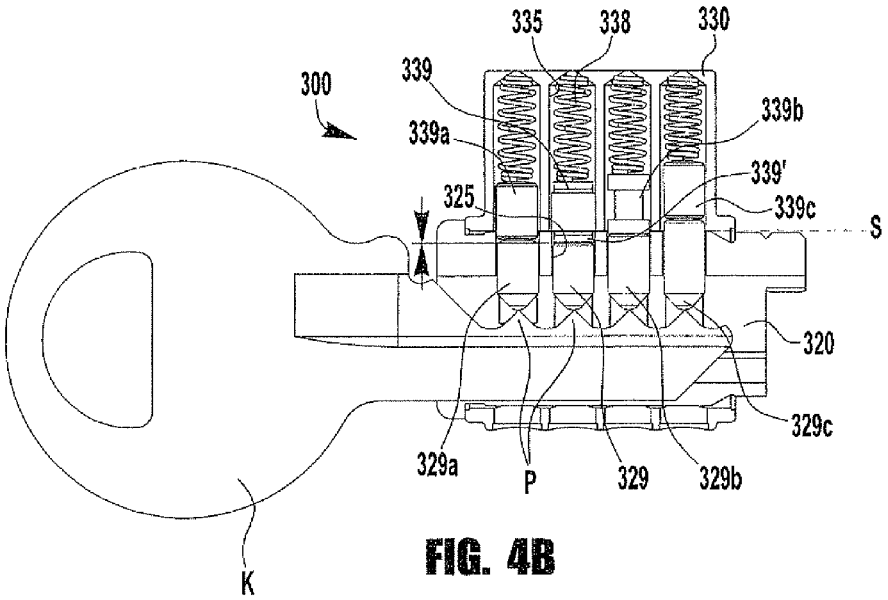
FIG. 4B illustrates a schematic cross sectional view of the lock of FIG. 4A, with a bump key inserted in a bump position.

A bump key with "taller" peaks P may narrow or eliminate the gap between the tumbler pin 329 and driver pin 339 when the peak P is aligned with the tumbler pin 329 (i.e., in a "bumped" position), which may increase the susceptibility to bumping of the gap enabling driver pin 339 beyond the shear line S. However, such a tactic may be effectively countered, for example, by providing one or more longer tumbler pins 329*c* (e.g., a code 2 or 7 tumbler pin) in one or more of the other plug channels 325. In such an embodiment, a bump key K having peaks P tall enough to eliminate the gap between the tumbler pin 329 and the gap enabling driver pin 339 in the bumped position would also extend the longer tumbler pin 329*c* above the shear line S between the plug 320 and the shell 330, as shown in FIGS. 4A and 4B, such that the longer tumbler pin 329*c* blocks rotation of the plug 320 during the bumping operation. In other words, when each of the tumbler pins is raised a predetermined equal distance from a central or key axis of the lock (for example, by a bump key) such that any gap between any of the tumbler pins and a corresponding driver pin has been eliminated, at least one of the tumbler pins will extend above the shear line, thereby blocking rotation of the plug. Since a would-be lock picker does not know which pin sets include either the gap enabling driver pin 339 or the longer tumbler pin 329*c,* it would be difficult and time consuming for him to identify and produce a suitable bump key K with peaks of differing heights to bump the gap enabling driver pin 339 while keeping the longer tumbler pin 329 from crossing the shear line S.

Since the exemplary tumbler pin 329, when bumped, separates from the bump key K before the tumbler pin 329 impacts the driver pin 339, the relatively low mass of the tumbler pin (compared to the key and tumbler pin in contact with each other and impacting the driver pin together) results in a reduced impact force on the driver pin, thereby inhibiting movement of the driver pin out of the plug channel. According to another inventive aspect of the present application, unauthorized operation of a lock by bumping may be further impeded by reducing the mass of the tumbler pin associated with the gap enabling driver pin, while maintaining the desired length of the tumbler pin, further reducing the impact force on the driver pin.

Figure 3F:
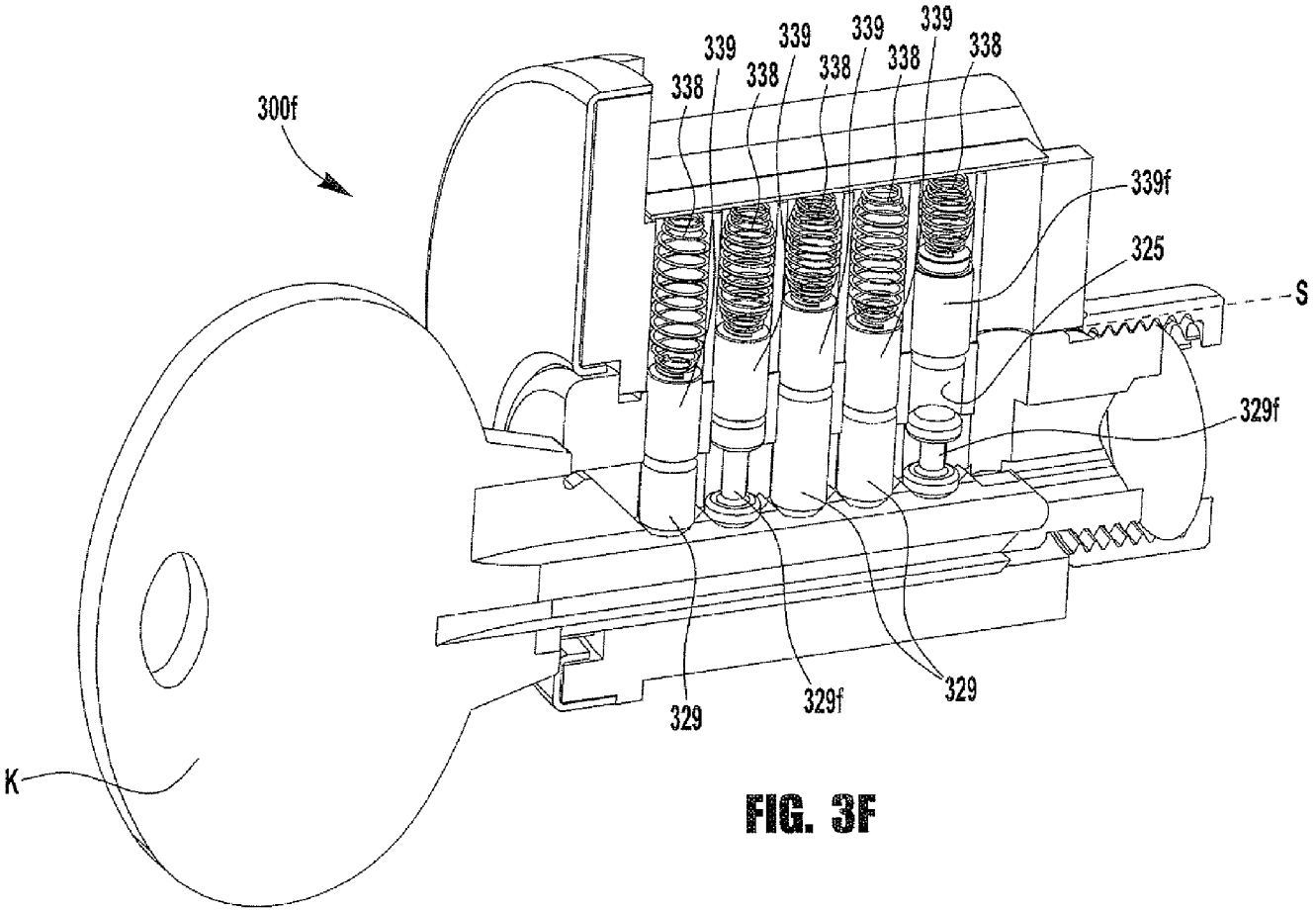
FIG. 3F illustrates a cross sectional perspective view of a pin tumbler cylinder lock having a reduced mass tumbler pin.

Many different configurations or methods may be utilized to provide a tumbler pin with a reduced mass per unit length, including, for example, use of a lower density material, such as plastic or aluminum (instead of brass or steel), or use of pins having portions of material removed, such as hollow or necked down configurations. In an exemplary embodiment, as illustrated in FIG. 3F, a gap enabling driver pin 339*f* is combined with a spool-shaped tumbler pin 329*f.* The spool-shaped tumbler pin 329*f* may have end portions consistent with those of the other tumbler pins 329, for consistent performance during proper operation of the lock 300*f,* with a necked clown portion allowing for a reduction in mass. When the lock is bumped (for example, with a bump key K), the reduced mass of the spool-shaped tumbler pin 329*f* imparts an even further reduced impact force on the corresponding driver pin 339*f,* preventing the driver pin 339*f* from separating from the plug channel 325. The spool-shaped configuration of the tumbler pin 329*f* may further impede lock picking or bumping, for example, by hanging up on the shear line S to impede rotation after bumping or lock picking, or by providing a false indication that a lock picking tool has engaged the bottom edge of the corresponding driver pin 339*f.* Further, spool shaped tumbler pins 329*f* may be included in one or more channels having non-gap enabling (or standard) driver pins 339, making it more difficult for a would-be lock picker to identify the channel or channels in which a gap enabling driver pin 329*f* is disposed.

The narrower or stepped portion of the gap enabling driver pin 339 may comprise a number of different contours, tapers or shapes. In one embodiment, the end portion may be shaped to provide a radial gap between the driver pin 339 and the edge of the plug channel 325. This radial gap may be provided, for example, by a driver pin 339 having a stepped portion 339' with a radially outward lower portion extending from a tapered, necked down, or otherwise recessed portion of the stepped end, where the recessed portion aligns with the edge of the plug channel 325 when the plug 320 is in a locked condition. In the illustrated embodiments of FIGS. 3A-5B, the stepped end of the driver pin 339 includes an inward or reverse tapered end portion 339', which provides for a radial gap R (see FIG. 3C) between the driver pin end portion 339' and the edge of the plug channel 325. While many different degrees of taper may be provided, in one embodiment, an end portion 339' of a driver pin 339 is tapered at an angle a of approximately 10°-15° relative to a cylindrical outer surface of the main portion of the driver pin 339.

As one benefit of a reverse taper or other such configuration, when the lock is aggressively bumped, the radial gap R protects the edge of the plug channel 325 from deformation or chamfering caused by impact between the driver pin 339 and the edge of the plug channel 325. This type of damage may otherwise make the plug channel 325 more susceptible to dislodging of the driver pin 339. Also, if torque is applied to the cylinder plug 320 prior to bumping, the end 339' of the driver pin 339 may engage or interlock with the side of the plug channel 325, thereby impeding axial movement of the driver pin 339 due to bumping. Further, aggressive bumping of the lock 300 may tend to cause the end 339' of the driver pin 339 to mar or deform the inner surface of the plug channel 325 (i.e., inward of the channel edge), which may further impede dislodging of the driver pin 339 by bumping. Additionally, the marring or witness marks caused by aggressive bumping may provide visual evidence, upon disassembly of the lock 300, that unauthorized access by bumping had been attempted.

In one exemplary embodiment, all or part of the driver pin 339 may be provided in a more durable or wear resistant material (as compared to, for example, the plug 330 or to other driver pins in the assembly), such as, for example, stainless steel, such that the end 339' of the driver pin 339 is less likely to wear or become damaged during such a bump attack. Additionally or alternatively, a driver pin 339 may be configured such that at least the end portion 339' is harder than the material of the plug 320, such that the plug 320 (and not the driver pin end portion 339' is worn due to aggressive bumping of the lock 300. For example, the driver pin 339 may be surface or through hardened to increase durability. As one example, a steel driver pin 339 may be heat treated at least at the end portion 339' for increased durability of the plug channel engaging surfaces.

As another benefit of the reverse tapered end portion 339', resistance to lock picking may be provided by the inclusion of an added step at the end of the driver pin 339, which may provide a false indication that a lock picking tool has engaged the edge of the tumbler pin 329 (similar to a spool-type driver pin, as known in the art). Further, as shown, the opposite end of the driver pin 339 may also include a tapered or contoured end portion 339", which may, but need not, match the other end portion 339'. This may allow for assembly of the driver pin 339 in the key cylinder in either direction, for example, to improve assembly efficiency.

Figure 5A:
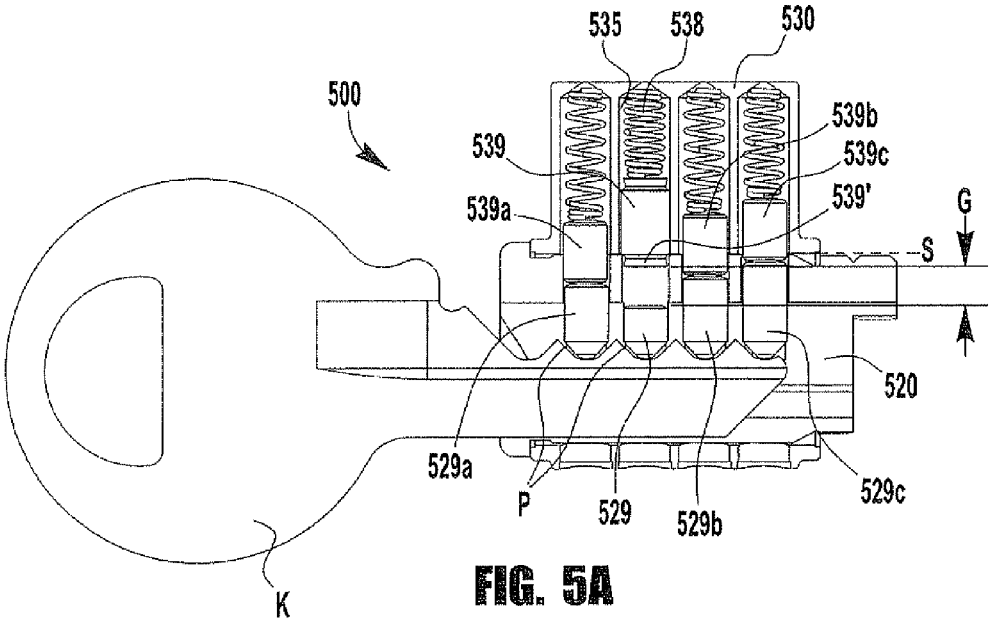
FIG. 5A illustrates a schematic cross sectional view of another pin tumbler cylinder lock, with a bump key inserted in a pre-bump position.
Figure 5B:
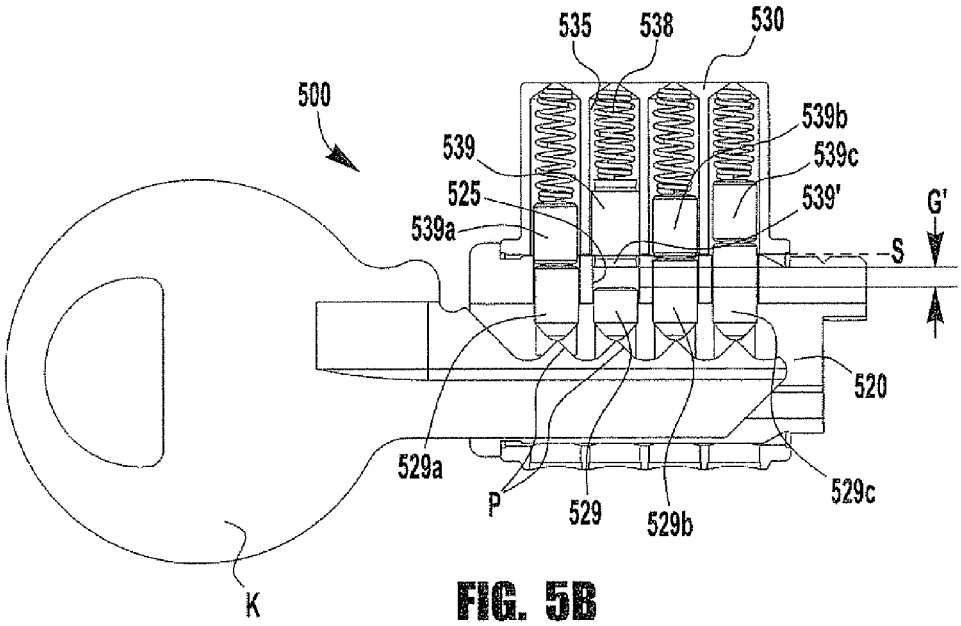
FIG. 5B illustrates a schematic cross sectional view of the lock of FIG. 5A, with a bump key inserted in a bump position.

According to another inventive aspect of the present application, to inhibit separation of a driver pin from a plug channel due to bumping (either alone or in combination with one or more of the other bump inhibiting techniques described herein), a biasing force applied to the driver pin (such as by a spring) may be increased to counter the impact force of the tumbler pin against the driver pin. This biasing force may be increased using many different configurations or techniques, such as, for example, using additional or stiffer/stronger springs or using additional or different biasing components, such as a compressible plastic or elastomer components. According to another inventive aspect of the present application, as shown in FIGS. 5A and 5B, a biasing force applied to the driver pin 539 may be increased by lengthening the driver pin 539, thereby pre-loading or further compressing the spring 538 above the driver pin 539, which causes the spring 538 to exert an increased biasing force against the driver pin 539, both in the locked or pre-bump condition, and during any upward movement the driver pin 539, such as, for example, during a bumping operation. By pre-loading the spring 538 using a longer driver pin 539, an increased biasing force may be achieved while using springs 538 of standard or substantially uniform strength properties throughout the lock. In the exemplary embodiment, where a shorter tumbler pin 529 is paired with the elongated driver pin 539, operation of the lock (for example, with an authorized key) will not over-compress or crush the spring. Further, while the pre-loaded spring arrangement may be provided in more than one of the pin sets, by limiting the number of pre-loaded springs 538 within the lock, the force required to insert an authorized key may be reduced. Also, where multiple pin sets including longer tumbler pins (e.g., code 3-7 pins), such pin sets may be provided with a reduced length (but still elongated) driver pin and/or a reduced length spring (not shown) to avoid over-compressing or crushing the spring.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A driver pin for a pin tumbler cylinder lock, the driver pin comprising:

a cylindrical main body portion having a first outer diameter sized to be retained in a shell channel of a key cylinder lock shell;

a recessed portion stepped relative to the main body portion and having a second outer diameter smaller than the first outer diameter; and an end portion extending radially outward of the recessed portion and having a third outer diameter greater than the second outer diameter and smaller than the first outer diameter, the end portion being sized to be received in a plug channel of a key cylinder lock plug, with the recessed portion being disposed between the main body portion and the end portion.

2. The driver pin of claim 1, wherein the driver pin is tapered outward from the recessed portion to the end portion.

3. A pin tumbler cylinder lock comprising:

a shell having a plurality of shell channels;

a plug disposed in the shell, the plug having plurality of plug channels that align with the plurality of shell channels along a shear line between the plug and the shell when the plug is in a locked condition;

a plurality of tumbler pins disposed in the corresponding plurality of plug channels; and a plurality of driver pins disposed in the corresponding plurality of shell channels;

wherein at least a first driver pin of the plurality of driver pins includes:

a cylindrical main body portion having a first outer diameter sized to be retained in the corresponding shell channel, the first outer diameter being greater than an inner diameter of the corresponding plug channel;

a recessed portion stepped relative to the main body portion and having a second outer diameter smaller than the first outer diameter; and an end portion extending radially outward of the recessed portion and having a third outer diameter greater than the second outer diameter and smaller than the first outer diameter, the third outer diameter being smaller than the inner diameter of the corresponding plug channel, such that the end portion is received in the corresponding plug channel, with the recessed portion being disposed between the main body portion and the end portion.

4. The pin tumbler cylinder lock of claim 3, wherein the first driver pin is tapered outward from the recessed portion to the end portion.

5. The pin tumbler cylinder lock of claim 3, wherein engagement of the main body portion of the first driver pin with an outer surface of the plug provides for an axial gap between the first driver pin and the corresponding tumbler pin.

6. The pin tumbler cylinder lock of claim 3, wherein engagement of the end portion of the first driver pin with an internal surface of the corresponding plug channel provides for a radial gap between the recessed portion of the first driver pin and the internal surface of the corresponding plug channel.

7. The pin tumbler cylinder lock of claim 3, wherein at least the end portion of the first driver pin is harder than the plug.

8. The pin tumbler cylinder lock of claim 3, wherein the first driver pin is harder than the plug.

9. The pin tumbler cylinder lock of claim 3, further comprising a plurality of springs disposed in the corresponding shell channels for biasing the corresponding driver pins towards the corresponding tumbler pins, wherein the first driver pin is configured to extend within the first shell channel farther than a second driver pin of the plurality of driver pins extends within the corresponding shell channel when the plug is in the locked condition, such that a first biasing force applied on the first driver pin by the corresponding spring is substantially greater than a second biasing force applied on the second driver pin by the corresponding spring.

* * * * *